US006524070B1

(12) United States Patent
Carter

(10) Patent No.: US 6,524,070 B1
(45) Date of Patent: Feb. 25, 2003

(54) METHOD AND APPARATUS FOR REDUCING ROTOR ASSEMBLY CIRCUMFERENTIAL RIM STRESS

(75) Inventor: Stephen Michael Carter, Reading, MA (US)

(73) Assignee: General Electric Company, Schenectady, NY (US)

( * ) Notice: Subject to any disclaimer, the term of this patent is extended or adjusted under 35 U.S.C. 154(b) by 148 days.

(21) Appl. No.: 09/643,012

(22) Filed: Aug. 21, 2000

(51) Int. Cl.[7] ..... F01D 5/22
(52) U.S. Cl. ..... 416/193 A; 416/223 A
(58) Field of Search ..... 416/193 A, 248, 416/219 R, 220 R, 223 A

(56) References Cited

U.S. PATENT DOCUMENTS

| | | | | |
|---|---|---|---|---|
| 1,793,468 A | | 2/1931 | Densmore | |
| 2,415,380 A | | 2/1947 | Weber | |
| 2,429,324 A | | 10/1947 | Meisser | |
| 2,735,612 A | | 2/1956 | Hausmann | |
| 2,790,620 A | | 4/1957 | Rankin | |
| 2,918,254 A | | 12/1959 | Hausammann | |
| 3,095,180 A | | 6/1963 | Clarke et al. | |
| 3,389,889 A | | 6/1968 | Penny | |
| 3,481,531 A | | 12/1969 | MacArthur et al. | |
| 3,529,631 A | | 9/1970 | Riollet | |
| 3,584,969 A | | 6/1971 | Aiki et al. | |
| 3,661,475 A | | 5/1972 | Anderson et al. | |
| 3,730,644 A | | 5/1973 | Jubb | |
| 3,890,062 A | | 6/1975 | Hendrix et al. | |
| 3,927,952 A | | 12/1975 | Kirby | |
| 3,951,611 A | | 4/1976 | Morrill | |
| 4,135,857 A | * | 1/1979 | Pannone et al. | 416/248 |
| 4,188,169 A | | 2/1980 | Mowill | |
| 4,335,997 A | | 6/1982 | Ewing et al. | |
| 4,420,288 A | | 12/1983 | Bischoff | |
| 4,465,433 A | | 8/1984 | Bischoff | |
| 4,587,700 A | | 5/1986 | Curbishley et al. | |
| 4,659,288 A | | 4/1987 | Clark et al. | |
| 4,671,739 A | | 6/1987 | Read et al. | |
| 4,704,066 A | | 11/1987 | Weissbacher | |
| 4,866,985 A | | 9/1989 | Futrell, II | |
| 4,884,948 A | | 12/1989 | Sikorski | |
| 5,007,801 A | | 4/1991 | Hopfensperger et al. | |
| 5,018,271 A | | 5/1991 | Bailey et al. | |
| 5,061,154 A | | 10/1991 | Kington | |
| 5,215,439 A | | 6/1993 | Jansen et al. | |
| 5,244,345 A | | 9/1993 | Curtis | |
| 5,397,215 A | * | 3/1995 | Spear et al. | 416/193 A |
| 5,466,123 A | | 11/1995 | Rose | |
| 5,554,004 A | | 9/1996 | Stewart | |
| 5,735,673 A | | 4/1998 | Matheny et al. | |
| 5,775,878 A | | 7/1998 | Maumus et al. | |
| 6,017,186 A | * | 1/2000 | Hoeger et al. | 416/193 A |
| 6,217,283 B1 | * | 4/2001 | Ravenhall et al. | 416/2 |
| 6,283,713 B1 | * | 9/2001 | Harvey et al. | 416/248 |

FOREIGN PATENT DOCUMENTS

| | | |
|---|---|---|
| DE | 191354 | 8/1957 |
| SU | 756083 | 8/1980 |

* cited by examiner

*Primary Examiner*—F. Daniel Lopez
*Assistant Examiner*—James M McAleenan
(74) *Attorney, Agent, or Firm*—Nathan D. Herkamp; Armstrong Teasdale LLP

(57) ABSTRACT

A rotor assembly for a gas turbine engine operates with reduced circumferential rim stress. The rotor assembly includes a rotor including a plurality of rotor blades and a radially outer platform. The rotor blades extend radially outward from the platform. A root fillet extends circumferentially around each blade between the blades and platforms. The platforms include an outer surface including a plurality of indentations extending between adjacent rotor blades. Each indentation extends from a leading edge of the platform to a trailing edge of the platform with a depth that tapers to an approximate zero depth at the trailing edge.

20 Claims, 3 Drawing Sheets

METHOD AND APPARATUS FOR REDUCING ROTOR ASSEMBLY CIRCUMFERENTIAL RIM STRESS

BACKGROUND OF THE INVENTION

This application relates generally to gas turbine engines and, more particularly, to a flowpath through a rotor assembly.

A gas turbine engine typically includes at least one rotor assembly including a plurality of rotor blades extending radially outwardly from a plurality of platforms that circumferentially bridge around a rotor disk. The rotor blades are attached to the platforms and root fillets extend between the rotor blades and platforms. An outer surface of the platforms typically defines a radially inner flowpath surface for air flowing through the rotor assembly. Centrifugal forces generated by the rotating blades are carried by portions of the platforms below the rotor blades. The centrifugal forces generate circumferential rim stress concentration between the platform and the blades.

Additionally, a thermal gradient between the platform and the rotor disk during transient operations generates thermal stresses which may adversely impact a low cycle fatigue life of the rotor assembly. In addition, because the platform is exposed directly to the flowpath air, thermal gradients and rim stress concentrations may be increased. Furthermore, as the rotor blades rotate, blade roots may generate local forces that may further increase the rim stress concentration.

To reduce the effects of circumferential rim stress concentration, additional material is attached to each root fillet to increase a radius of the root fillet. However, because the root fillets are exposed to the flowpath air, the additional material attached to the root fillets may be detrimental to flow performance.

Other known rotor assemblies include a plurality of indentations extending between adjacent rotor blades over an axial portion of the platforms between the platform leading and trailing edges. The indentations are defined and formed as integral compound features in combination with the root fillets and rotor blades. Typically such indentations are formed using an electro-chemical machining, ECM, process. Because of dimensional control limitations that may be inherent with the ECM process, surface irregularities may be unavoidably produced. Such surface irregularities may produce stress radii on the platform which may result in increased surface stress concentrations. As a result, the surface irregularities then are milled with hand bench operations. Such hand bench operations increase production costs for the rotor assembly. Furthermore, because such indentations extend to the platform trailing edge, a forward facing step is created for an adjacent downstream stator stage. Such steps may be detrimental to flow performance.

BRIEF SUMMARY OF THE INVENTION

In an exemplary embodiment, a rotor assembly includes a plurality of indentations for facilitating a reduction in circumferential rim stress during engine operations. More specifically, in the exemplary embodiment, the rotor assembly includes a rotor including a plurality of rotor blades and a radially outer platform. The rotor blades are attached to the platform and extend radially outward from the platform. The platforms are circumferentially attached to a rotor disk. A root fillet provides support to rotor blade/platform interfaces and extends circumferentially around each rotor blade/platform interface between the rotor blade and platform. The platform includes an outer surface having a plurality of indentations that extend between adjacent rotor blades. Each indentation extends from a leading edge of the platform to a trailing edge of the platform. Each indentation is tapered to terminate at the platform trailing edge with a depth that is approximately equal zero.

During operation, as the rotor blades rotate, centrifugal loads generated by the blades are carried by portions of the platforms below each rotor blade. As air flows between adjacent rotor blades, the platform indentations facilitate a reduction in thermal gradients that may develop between the platform and rotor disk, thus, reducing thermal stresses that could impact a low cycle fatigue life (LCF) of the rotor assembly in comparison to other rotor assemblies. The indentations provide stress shielding and reduce stress concentrations by interrupting circumferential stresses below the rotor blade root fillets. Because a radius of each indentation is larger than a radius of each root fillet, a lower stress concentration is generated in the circumferential stress field and less circumferential rim stress concentration is generated between the platform and the rotor blades in comparison to other rotor assemblies. As a result, the rotor assembly facilitates high efficiency operation and reducing circumferential rim stress concentration.

DETAILED DESCRIPTION OF THE INVENTION

Figure 1:
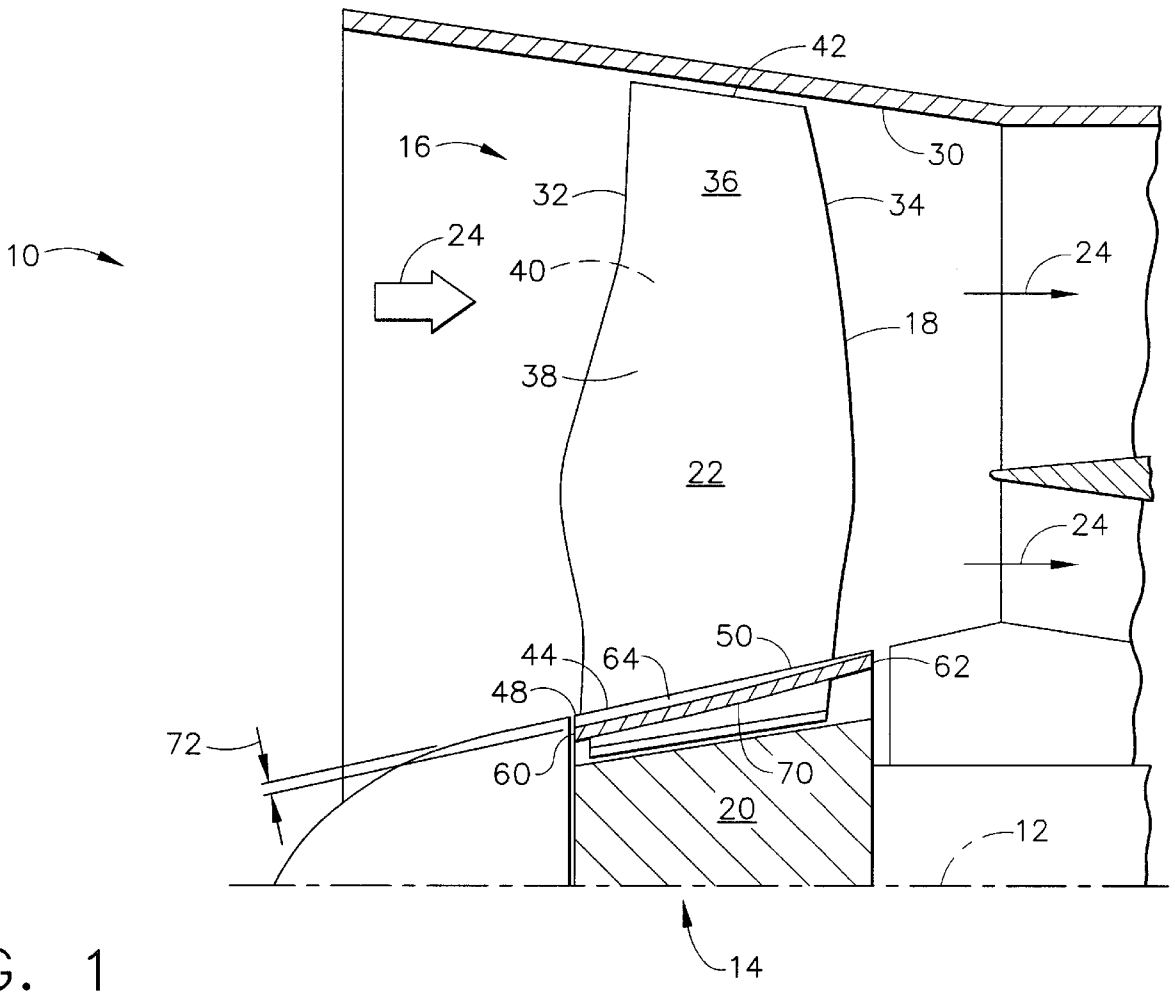
FIG. 1 is schematic illustration of a portion of a gas turbine engine.

FIG. 1 is a schematic illustration of a portion of a gas turbine engine 10 including an axis of symmetry 12. In an exemplary embodiment, gas turbine engine 10 includes a rotor assembly 14. Rotor assembly 14 includes at least one rotor 16 including a row of rotor blades 18 extending radially outward from a supporting rotor disk 20. In an alternative embodiment, rotor assembly one embodiment, each rotor is formed by one or more blisks (not shown). Rotor blades 18 are attached to rotor disk 20 in a known manner, such as by axial dovetails retained in corresponding dovetail slots in a perimeter of disk 20.

Rotor blades 18 are spaced circumferentially around rotor disk 20 and define therebetween a flowpath 22 through which air 24 is channeled during operation. Rotation of fan disk 20 and blades 18 imparts energy into air 24 which is initially accelerated and then decelerated by diffusion for recovering energy to pressurize or compress air 24. Flowpath 22 is bound circumferentially by adjacent rotor blades 18 and is bound radially with a shroud 30.

Rotor blades 18 include a leading edge 32, a trailing edge 34, and a body 36 extending therebetween. Body 36 includes a suction side 38 and a circumferentially opposite pressure side 40. Suction and pressure sides 38 and 40, repsectively, extend between axially spaced apart leading and trailing edges 32 and 34, respectively and extend in radial span between a rotor blade tip 42 and a rotor blade root 44.

Shroud 30 defines a radially outer border which circumferentially bridges adjacent rotor blades 18 near rotor blade tips 42. A plurality of inter-blade platforms 48 are spaced radially inward from rotor blade tips 42 and are radially outward from rotor disk 20. Individual platforms 48 circumferentially bridge adjacent rotor blades 18 at rotor blade roots 44 and are attached to rotor disk 20 in a known manner. Rotor blades 18 extend radially outward from platforms 48 and include root fillets (not shown in FIG. 1) extending between rotor blades 18 and platforms 48 to provide additional support to each rotor blade 18. In one embodiment, rotor blades 18 are formed integrally with platforms 48.

Each platform 48 includes an outer surface 50. Outer surfaces 50 of adjacent platforms 48 define a radially inner flowpath surface for air 24. Each platform 48 also includes a leading edge 60, a trailing edge 62, and an indentation 64 extending therebetween and increasing flowpath 22 area.

Indentations 64, described in more detail below, extend from platform leading edge 60 to platform trailing edge 62 to reduce circumferential rim stress concentration in rotor assembly 14. Each indentation 64 extends into platform 48 from platform outer surface 50 towards a platform inner surface 70 for a depth 72. Depth 72 is variable axially through indentation 64 and tapers such that depth 72 is approximately equal zero at platform trailing edge 62. Each indentation 64 is formed independently of each rotor blade 18 and associated rotor blade root fillet.

Figure 2:
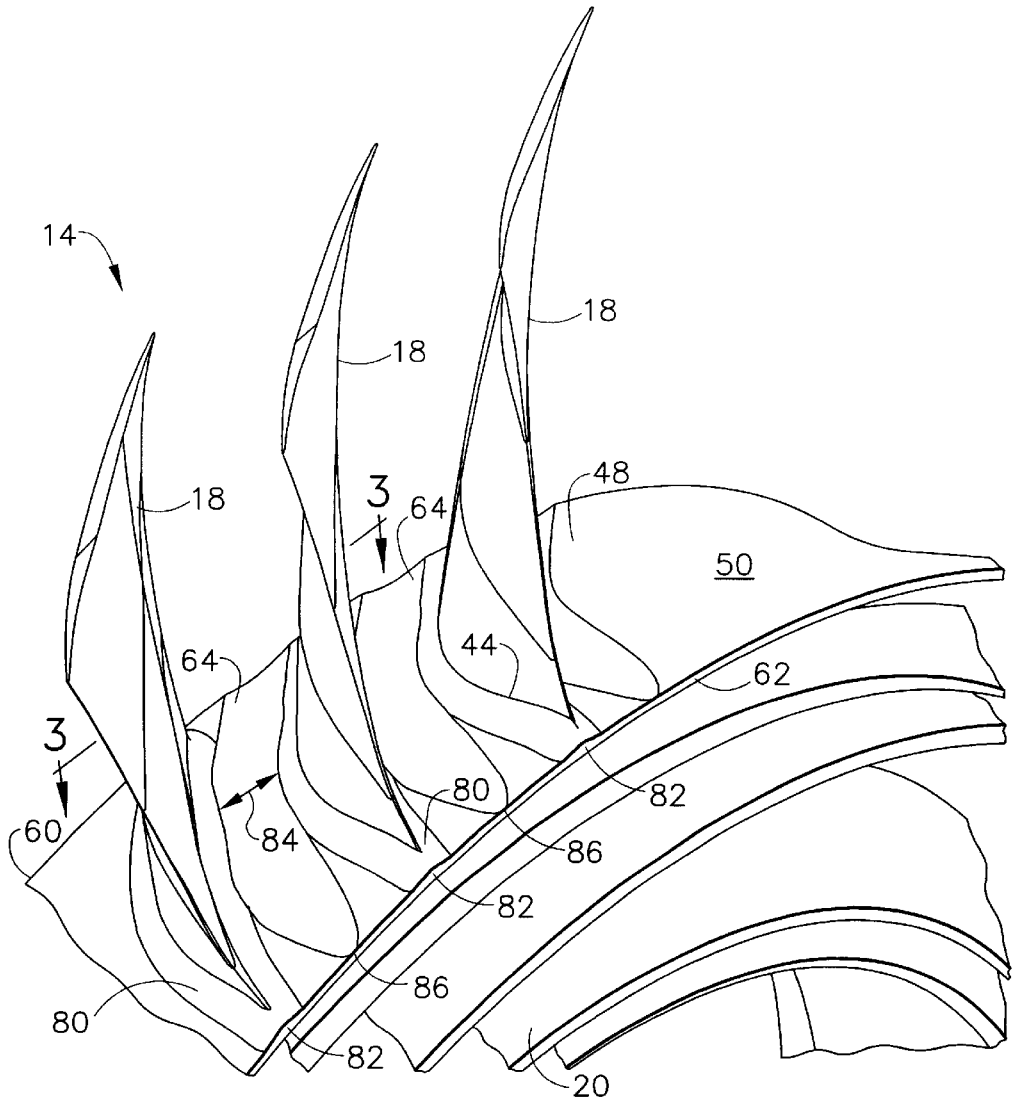
FIG. 2 is an aft view of a portion of a rotor assembly that may be used with the gas turbine engine shown in FIG. 1.
Figure 3:
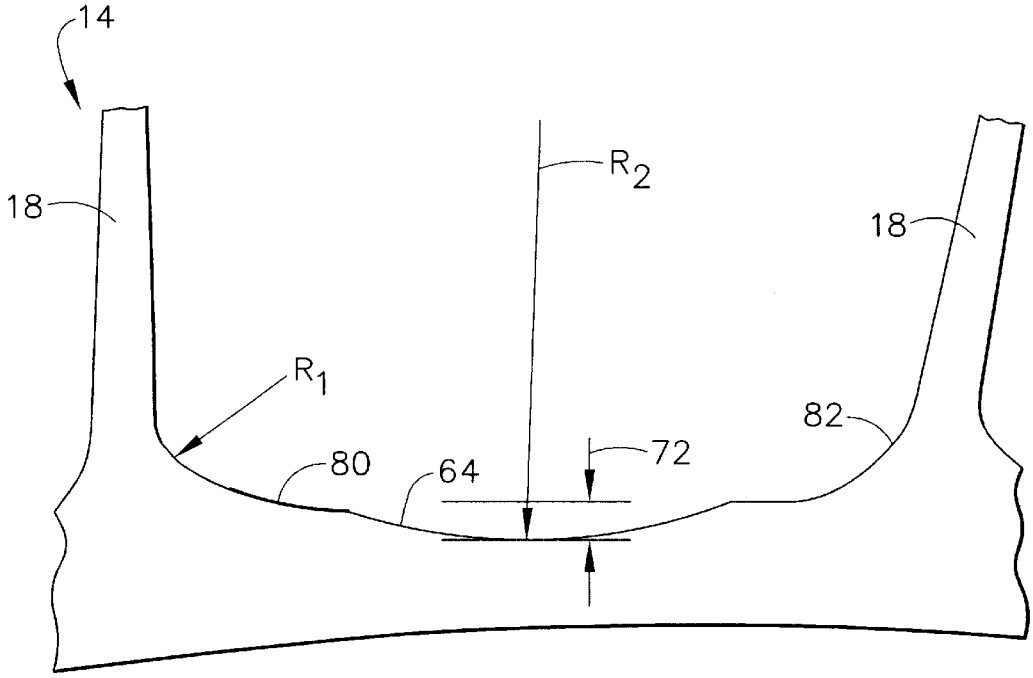
FIG. 3 is a cross-sectional view of a portion of the rotor assembly shown in FIG. 2.

FIG. 2 is an aft view of a portion of rotor assembly 14 including rotor blades 18 extending radially outwardly from platforms 48. FIG. 3 is a cross-sectional view of a portion of rotor assembly 14 taken along line 3—3 shown in FIG. 2. A rotor blade root fillet 80 circumscribes each rotor blade 18 adjacent rotor blade root 44 and extends between rotor blade 18 and platform outer surface 50. Each root fillet 80 is aerodynamically contoured to include a radius $R_1$ such that each root fillet 80 tapers circumferentially outwardly from an apex 82 adjacent rotor blade root fillet 80.

Indentations 64 are circumferentially concave and extend between adjacent rotor blades 18. More specifically, each indentation 64 extends between adjacent rotor blade root fillets 80. Each indentation 64 has a width 84 measured circumferentially between adjacent rotor blade root fillets 80. In one embodiment, indentations 64 are scallop-shaped. Indentation width 84 tapers to an apex 86 at platform trailing edge 62.

Each indentation depth 72 is also variable and tapers from a maximum depth 72 adjacent platform leading edge 60 to a depth 72 equal approximately zero at platform trailing edge 62. Because depth 72 is approximately zero at platform trailing edge 62, no forward facing steps are created at an adjacent stator stage (not shown). Each indentation 64 is concave and includes a radius $R_2$ that is larger than root fillet radius $R_1$. In one embodiment, depth 72 is approximately equal 0.05 inches adjacent platform leading edge 60, and root fillet radius $R_1$ is approximately one eighth as large as indentation radius $R_2$. Furthermore, depth 72 ensures that indentations 64 are below each rotor blade root fillet 80.

Indentations 64 are formed using, for example a milling operation, and are defined and manufactured independently of rotor blades 18 and rotor blade root fillets 80. Because indentations 64 are independent of rotor blades 18 and associated fillets 80, indentations 64 may be milled after an electro-chemical machining process has been completed. Indentations 64 are defined by a radial position and a base radius, $R_2$, at a series of axial locations between platform leading and trailing edges 60 and 62, respectively. Because indentations 64 are defined independently of rotor blades 18, indentations 64 may be added to existing fielded parts (not shown) to extend a useful life of such parts.

During operation, as blades 18 rotate, centrifugal loads generated by rotating blades 18 are carried by portions of platforms 48 below rotor blades 18. Outer surface 50 of platform 48 defines a radially inner flowpath surface for air 24. As air 24 flows between adjacent blades 18, indentations 64 facilitate a reduction of a development of thermal gradients between platform 48 and rotor disk 20 and thus, reduce thermal stresses that could impact a low cycle fatigue life (LCF) of rotor assembly 14. Indentations 64 provide stress shielding and further facilitate reducing stress concentrations by interrupting circumferential stresses below each rotor blade root fillet or at a depth below that of the root fillets. Because indentations radius $R_2$ is larger than root fillet radius $R_1$, less stress concentration is generated in the same circumferential stress field and less circumferential rim stress concentration is generated between platform 48 and rotor blades 18 at a location of the blade/platform interface (not shown) than may be generated if indentations radius $R_2$, was not larger than root fillet radius $R_1$. Reducing such stress concentration at the interface facilitates extending the LCF life of platform 48.

The above-described rotor assembly is cost-effective and highly reliable. The rotor assembly includes a plurality of rotor blades extending radially outward from a platform that includes a shape to reduce circumferential rim stress concentration. The platform includes a plurality of circumferentially concave indentations extending between adjacent rotor blades from a platform leading edge to a platform trailing edge. The indentations are independent of the rotor blades and associated rotor blade root fillets and includes a depth tapered to approximately zero at the platform trailing edge. During operation, the indentations provide stress shielding and reduce stress concentrations by interrupting circumferential stresses below a rotor blade root fillet tangency point. As a result, a lower stress concentration is generated in the same circumferential stress field and less circumferential rim stress concentration is generated between the rotor blades and the platform. Thus, a rotor assembly is provided which operates at a high efficiency and reduced circumferential rim stress concentration.

While the invention has been described in terms of various specific embodiments, those skilled in the art will recognize that the invention can be practiced with modification within the spirit and scope of the claims.

What is claimed is:

1. A method of fabricating a rotor assembly to facilitate reducing circumferential rim stress concentration in a gas turbine engine, the rotor assembly including a rotor that includes an outer platform and a plurality of circumferentially spaced apart rotor blades extending radially outward from the outer platform, the outer platform including an outer surface, a leading edge, and a trailing edge, each rotor blade including a root fillet extending between the outer platform outer surface and each rotor blade, said method comprising the steps of:

forming in the outer platform outer surface, between each set of adjacent rotor blades, one indentation, and thereby forming a plurality of indentations, and extending the indentations from the outer platform leading edge to the outer platform trailing edge.

2. A method in accordance with claim 1 wherein said step of forming a plurality of indentations further comprises the step of forming one outer surface indentation to have a circumferentially concave shape that extends between adjacent rotor blades.

3. A method in accordance with claim 1 wherein said step of forming a plurality of indentations further comprises the step of forming one outer surface indentation to have a depth that tapers from the outer platform leading edge to the outer platform trailing edge.

4. A method in accordance with claim 3 wherein said step of forming a plurality of indentations further comprises the step of forming one outer surface indentation such that each indentation has a depth equal approximately zero at the outer platform trailing edge.

5. A method in accordance with claim 1 wherein said step of forming a plurality of indentations further comprises the step of machining the rotor assembly to form the plurality of indentations.

6. A rotor assembly for a gas turbine engine, said rotor assembly comprising a rotor comprising a plurality of rotor blades and a radially outer platform, said plurality of rotor blades extending radially outwardly from said platform, said outer platform comprising an outer surface, a leading edge, and a trailing edge, said outer surface comprising one indentation, formed between each set of adjacent rotor blades, and thereby forming a plurality of indentations, and the indentations extending from the outer platform leading edge to said outer platform trailing edge, said outer surface configured to reduce circumferential rim stress concentration between each of said rotor blades and said outer platform.

7. A rotor assembly in accordance with claim 6 wherein said one outer surface indentation as having a circumferentially concave shape extending between adjacent said rotor blades.

8. A rotor assembly in accordance with claim 6 wherein said one outer surface indentation extends a depth into said outer surface, said indentation depth variable between said outer platform leading and trailing edges.

9. A rotor assembly in accordance with claim 8 wherein said indentation depth tapered from said outer platform leading edge to said outer platform trailing edge such that each of said indentations has a depth approximately equal zero at said outer platform trailing edge.

10. A rotor assembly in accordance with claim 6 wherein said one outer surface indentation is machined into said outer surface.

11. A rotor assembly in accordance with claim 6 wherein said rotor further comprises a plurality of root fillets extending between each said rotor blade and said outer surface, said one outer surface indentation between adjacent said rotor blade root fillets.

12. A rotor assembly in accordance with claim 11 wherein each of said plurality of root fillets has a first radius, each of said one outer surface indentation has a second radius larger than said root fillet first radius.

13. A gas turbine engine comprising a rotor assembly comprising a rotor comprising a plurality of rotor blades and a radially outer platform, said plurality of rotor blades extending radially outwardly from said rotor assembly outer platform, each of said rotor blades comprising a root fillet extending between each of said rotor blades and said rotor assembly outer platform, said rotor assembly outer platform comprising an outer surface, a leading edge, and a trailing edge, said outer surface comprising each set of adjacent rotor blades, and thereby forming a plurality of indentations, and the indentations extending from the outer platform leading edge to said outer platform trailing edge, said outer surface configured to reduce circumferential rim stress concentration between each of said rotor assembly rotor blades and said rotor assembly outer platform.

14. A gas turbine engine in accordance with claim 13 wherein said one outer surface indentation has a circumferentially concave shape between adjacent said rotor blades.

15. A gas turbine engine in accordance with claim 13 wherein said one outer platform surface indentation is scallop-shaped and extend a depth into said outer platform surface, said indentation depth variable between said outer platform leading and trailing edges.

16. A gas turbine engine in accordance with claim 13 wherein said one outer platform surface indentation has a depth extending into said outer platform surface , wherein the depth is tapered from said outer platform leading edge to said outer platform trailing edge such that each of said one outer platform surface indentation has a depth approximately equal zero at said outer platform trailing edge.

17. A gas turbine engine in accordance with claim 13 wherein said one outer platform surface indentation is machined into said outer surface.

18. A gas turbine engine in accordance with claim 13 wherein each of said plurality of root fillets has a first radius, each of said one outer platform surface indentation has a second radius.

19. A gas turbine engine in accordance with claim 18 wherein said outer platform surface indentation second radius is than said root fillet first radius.

20. A gas turbine engine in accordance with claim 13 wherein said outer platform surface indentations extend between adjacent said root fillets.

* * * * *

UNITED STATES PATENT AND TRADEMARK OFFICE

CERTIFICATE OF CORRECTION

PATENT NO. : 6,524,070 B1
DATED : February 25, 2003
INVENTOR(S) : Carter

It is certified that error appears in the above-identified patent and that said Letters Patent is hereby corrected as shown below:

Column 6,
Line 11, between “comprising” and “each” insert -- one indentation, formed between --.

Signed and Sealed this

Twenty-sixth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,524,070 B1 
DATED : February 25, 2003
INVENTOR(S) : Carter

It is certified that error appears in the above-identified patent and that said Letters Patent is hereby corrected as shown below:

Column 6,
Line 43, between “is” and “than” insert -- larger --.
Line 45, delete “indentations extend” and insert therefor -- indentation extends --.

Signed and Sealed this

Fourth Day of November, 2003

JAMES E. ROGAN
*Director of the United States Patent and Trademark Office*